US005776580A

United States Patent [19]

Rasmussen et al.

[11] Patent Number: 5,776,580

[45] Date of Patent: Jul. 7, 1998

[54] INSULATING ELEMENT AND METHOD FOR MANUFACTURING THE ELEMENT

[75] Inventors: Jeppe Rasmussen, Virum; Luis Nørgaard, Roskilde, both of Denmark

[73] Assignee: Rockwool International A/S, Hedehusene, Denmark

[21] Appl. No.: 727,434

[22] PCT Filed: Apr. 11, 1995

[86] PCT No.: PCT/DK95/00153

§ 371 Date: Oct. 11, 1996

§ 102(e) Date: Oct. 11, 1996

[87] PCT Pub. No.: WO95/28533

PCT Pub. Date: Oct. 26, 1995

[30] Foreign Application Priority Data

Apr. 13, 1994 [DK] Denmark ..... 0427/94

[51] Int. Cl.[6] ..... B32B 31/12

[52] U.S. Cl. ..... 428/74; 428/75; 156/256; 156/259; 156/260; 156/264

[58] Field of Search ..... 428/74, 75; 156/259, 156/256, 260, 264

[56] References Cited

U.S. PATENT DOCUMENTS

| | | | |
|---|---|---|---|
| 2,160,001 | 5/1939 | Saborsky | 428/74 |
| 2,782,465 | 2/1957 | Palmer, Jr. | 428/74 X |
| 3,940,526 | 2/1976 | Fathi | 428/117 |
| 4,446,186 | 5/1984 | Rasmussen | 428/74 |
| 5,073,426 | 12/1991 | Blaauw | 428/74 X |
| 5,230,763 | 7/1993 | Roth et al. | 156/254 |

FOREIGN PATENT DOCUMENTS

| | | |
|---|---|---|
| 568270A | 4/1993 | European Pat. Off. . |
| 938294 | 3/1948 | France . |
| 826500 | 7/1949 | Germany . |

*Primary Examiner*—Daniel Zirker

*Attorney, Agent, or Firm*—Watson Cole Stevens Davis, P.L.L.C.

[57] ABSTRACT

An insulating plate element includes a heat insulating core layer (1) open to diffusion and which is coated on both sides with a diffusion-proof outer layer (4.5), the core layer (1) being divided into cells by means of diffusion-proof separating layers (3) that extend perpendicular to the diffusion-proof outer layers (4.5) and are connected thereto in a diffusion-proof manner.

13 Claims, 3 Drawing Sheets

INSULATING ELEMENT AND METHOD FOR MANUFACTURING THE ELEMENT

BACKGROUND OF THE INVENTION

The present invention relates to an insulating plate element that includes a heat-insulating core layer open to diffusion and a vapor-proof outer layer coated on both sides thereof.

Insulating elements of the above-mentioned type, wherein the heat-insulating core layer is formed of mineral wool, are used i.a., for insulating, cooling and freezing chambers, i.e., chambers having a temperature below the dew point of the ambient air. This means that if leakage occurs in an external vapor-proof outer layer, water vapor will diffuse into the insulating layer, and condensed water will be formed on the inner side of the inner vapor-proof layer and, depending on the temperature of the inner vapor-proof layer, an ice layer can be formed. The formation of ice, which cannot readily be observed since it takes place within the insulating element, will gradually increase and may in time lead to destruction of the insulating layers. Simultaneously, a progressive reduction of the insulating capacity of the defective insulating element will occur.

DE Patent No. 826,500 describes a chamber insulating element of the type described above wherein the core layer is formed of layers of separate bodies, and wherein vapor-proof films are provided between the layers. In case a leakage occurs in the external vapor-proof layer of such element, the resulting damage may be limited to the outermost layer of separate bodies, but the insulating capacity of the insulating element will be reduced over its entire outside. In addition, the known chamber insulating elements are difficult to produce on an industrial scale.

FR-A-938294 discloses an insulating sandwich element formed of a core layer of fibre glass lamellae separated by intervening layers of a thin flexible material, such as Kraft paper, and covered on one or both sides by outer plates of wood or a similar material so as to obtain a low weight element which is resistant to compression in a direction perpendicular to the outer plate(s).

It is the object of the invention to provide an insulating plate element of the type described above whereby the damage resulting from a leakage in any of the vapor-proof outer layers may be limited to affect only a small portion of the element and which element is also easy to produce on an industrial scale.

SUMMARY OF THE INVENTION

This object is obtained with the insulating element according to the invention wherein the core layer is divided into cells by means of vapor-proof separating layers which extend perpendicular to the vapor-proof outer layers and are connected thereto in a vapor-proof manner.

Owing to this division of the insulating plate element into vapor-proof cells, leakages, if any, will allow penetration of moisture into only a very limited portion of the element, and any formation of condensate and/or ice will result in only a slight reduction of the overall insulating capacity of the insulating element. Moreover, the separating layers contribute to increasing the bending strength and stiffness of the insulating element.

DK Patent Publication No. 137,579 discloses reinforced insulating elements which include strips of a soft insulating material, e.g., mineral wool, and wherein reinforcing layers which serve to impart to the insulating elements improved strength properties are provided between the strips. These reinforcing layers are made of a curable binder or adhesive in a fluid state, but the publication does not indicate that the reinforcing layers are to be vapor-proof. The known insulating element may be provided with external rigid layers or sheets but the publication does not indicate that these layers or sheets are vapor-proof or that they are connected to the reinforcing layers.

DD Patent No. 297,114 A5 describes a plate element for the adsorption of electromagnetic waves, in particular radar waves. The known elements are formed of a carrier sheet of, e.g., reinforced aluminium film onto which parallel strips of mineral wool, such as glass wool, are adhered, the strips being separated by an electrically conductive material such as a graphite-saturated non-woven glass fibre web or a metal foil. The known element may also include an additional carrier sheet of an electrically non-conductive material, such as a non-woven glass fibre web, i.e., a material which is not vapor-proof.

EP 0 568 270 A1 describes a panel formed of two outer layers of an impregnated fibre material and having an internal cellular structure of a fibre material, the cells including a filler formed of a mixture of a granular inorganic insulating material and a material which releases water upon intensive heating. The walls between the cells are not vapor-proof.

French Patent No. 938 294 also describes a panel divided into cells for construction purposes. This known panel includes a core layer of combined glass fibre lamellae, the core layer being covered on both sides by plates of wood or the like non-vapor proof material.

The core layer of the insulating element according to the invention preferably is formed of elongated mineral fibre elements (mineral fibre lamellae), and in particular of mineral fibre lamellae wherein the fibres are oriented in planes substantially perpendicular to the outer layers. Such lamellae impart to the insulating elements good resistance to compression perpendicular to the plate plane.

It is preferred to use core materials of rock wool, but glass wool and slag wool are also suitable.

Conveniently, the core layer has a thickness of from 50 to 300 mm, and preferably of from 100 to 200 mm, and when it consists of, e.g., rock wool, the density is preferably from 50 to 170 kg/m$^3$.

The width of the lamellae and thus of the vapor-proof cells is conveniently between 50 and 300 mm, and preferably between 100 and 200 mm.

The vapor-proof separating layers between the cells preferably have a diffusion resistance which exceeds 75 m$^2$·sec·GPa/kg, and preferably include a foil, such as a metal foil or plastics film which is optionally reinforced with, e.g., glass fibres.

When a metal foil is used, such as an aluminium foil, the thickness is conveniently from 0.01 to 0.15 mm. When using a plastics film, such as a polyethylene, polypropylene, polyvinyl chloride, polyacrylate or polyester film, the thickness is preferably from 0.05 to 0.2 mm.

The vapor-proof separating layers may also be formed of impregnated paper, a combination of paper and foil, e.g., aluminium-coated paper or a vapor-proof coat of paint or lacquer.

The vapor-proof outer layers, which preferably have a diffusion resistance of above 75 m$^2$·sec·GPa/kg, may be formed of a metal layer of, e.g., stainless steel or aluminium, optionally coated with a plastics layer of a coat of paint.

When using a metal layer of stainless steel, the layer thickness is conveniently between 0.4 and 1 mm, and when using a metal layer of aluminium, the layer thickness is conveniently between 0.7 and 1.5 mm. Preferably, rigid reinforcing outer layers are used, such as plastics sheets, e.g., Formica® sheets.

The vapor-proof connections between the separating layers and the outer layers are conveniently provided by using a foamed binder during the production of the insulating elements, e.g., a foamed polyurethane binder, such binder being capable of penetrating the core material around the separating layers and thus of providing tight connections between their edges and the outer layers.

The invention further relates to a method of producing the above-described insulating plate element. The method according to the invention is characterized in that at least one side of a plate or a web of an insulating core material which is open to diffusion is coated with a vapor-proof layer, that the plate or web thus produced is cut into lamellae, that the lamellae are turned 90°0 about their longitudinal axes and adhered to each other to form a plate or a web wherein strips of the vapor-proof layer form separating layers between adjacent lamellae, and that both sides of the plate or web thus produced are coated with a vapor-proof outer layer in such a manner that vapor-proof connections are obtained between the edges of the separating layers and the outer layers, and that the web is cut into desired lengths.

The application of the vapor-proof layer which forms separating layers in the final element onto the core material may be carried out in a manner known per se. When using a core material in the form of rock wool, the application of the vapor-proof layer may thus be carried out on the production line. For instance, the vapor-proof layer may be bonded to the core layer by using a fluid binder applied onto the core material surface or the vapor-proof layer by means of an anti-set-off roller. Suitable binders include thermoplastic materials, such as polyethylene, hot melt or a contact adhesive.

When the separating layer consists of a metal foil, the binder used may be a film of a thermoplastic material, such as polyethylene applied onto the metal foil, and which film in connection with the application of the metal foil is heated until melting by means of a heat roller.

The cutting of the plate or web coated with a vapor-proof layer may also be carried out on or outside the production line and in a manner known per se.

The cutting of the plate or the sheet may be carried out in its longitudinal direction or perpendicular thereto.

When the lamellae produced by the cutting have been turned 90°, they are once again bonded to each other to form a plate or a web wherein vapor-proof layers (separating layers) are arranged between adjacent lamellae. For this purpose hot melt is preferably used. The lamellae are preferably mutually displaced (e.g., by 150–250 mm) in their longitudinal direction prior to adhesion to obtain an offset structure. When using hot melt as a binder, it suffices to apply two strings of binder onto one of the two surfaces to be adhered, e.g., a string at the lowermost portion of the contact surface and a string at the uppermost one.

According to a preferred embodiment of the method according to the invention, a vapor-proof layer is applied onto the plate or the web of the core material which is open to diffusion, the layer extending in such a manner that the side edges of the plate or the sheet are covered. During cutting of the plate or the web, the portions of the vapor-proof layer to cover the side edges are conveniently folded across the web and following cutting of the lamellae, the portions may be unfolded and adhered to the ends of the lamellae. An adhesive, e.g., a contact adhesive, may be applied to these portions.

Alternatively, the plate or the sheet of core material which is open to diffusion may be coated with a vapor-proof material on one side as well as on the side edges prior to cutting.

By allowing the vapor-proof layer to cover the ends of the lamellae, the lamellae will be enclosed in the final product in a completely vapor-proof manner.

Prior to the application of an outer layer onto the plate or web thus produced, its under or top side may be smoothened to eliminate variations in thickness.

As mentioned, the outer layers are preferably connected with the plate or web thus produced by means of a foamed binder, e.g., a foamed polyurethane binder, the foamed state allowing the binder to penetrate into the portions of the core material which are adjacent to the edges of the separating layers. The penetration depth may thus be in the range of 1–1.5 mm.

BRIEF DESCRIPTION OF THE DRAWINGS

The invention will now be described in further detail with reference to the drawings, wherein.

DETAILED DESCRIPTION OF THE PREFERRED EMBODIMENT

Figure 1:
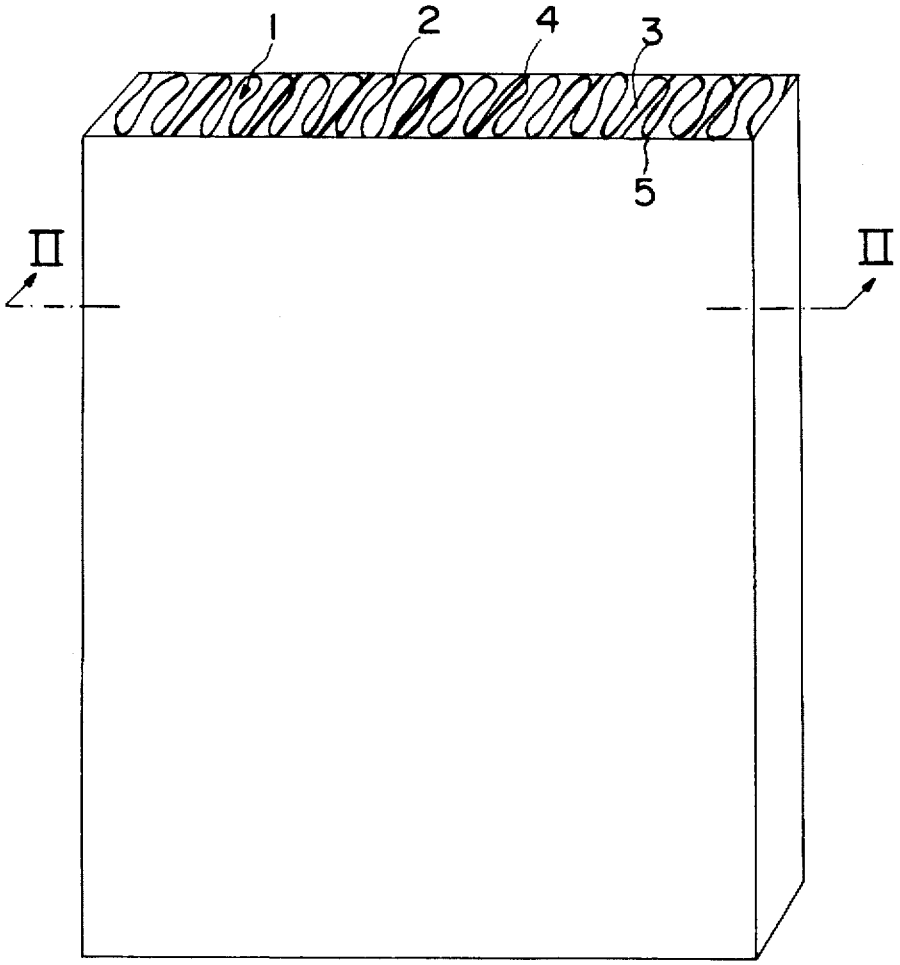
FIG. 1 is a perspective view of a preferred embodiment of an insulating element according to the invention.
Figure 2:
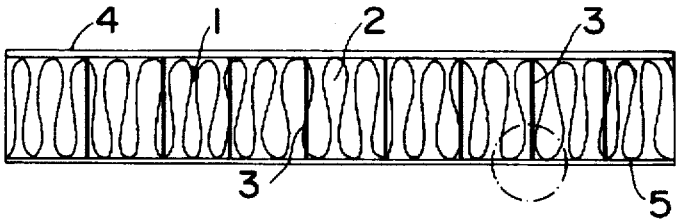
FIG. 2 is a cross sectional view along the line II—II of the insulating element according to FIG. 1.
Figure 3:
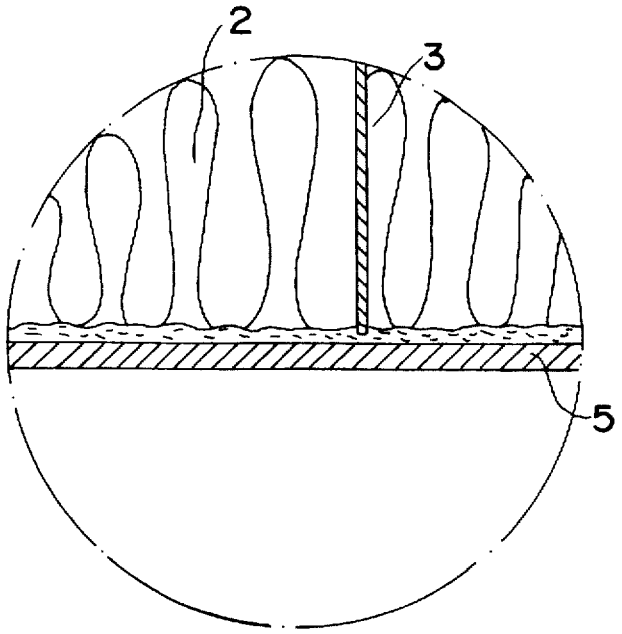
FIG. 3 is an enlarged-scale view of the circled-in portion of FIG. 2, and FIGS. 4*a*–4*d* are perspective illustrations of different steps of a preferred embodiment of the method according to the invention.

The insulating plate element shown in FIGS. 1–3 is formed of a core layer 1 which is composed of mineral fibre lamellae 2 separated by vapor-proof separating layers 3 and vapor-proof outer layers 4,5, wherein the separating layers 3 extend from the one outer layer 4 to the other 5 and along the side edges they are connected to the outer layers 4,5 in a vapor-proof manner.

As will appear from FIG. 3, this vapor-proof connection is obtained by embedding the side edges of the separating layers into a binder layer applied onto the inner side of each outer layer.

Figure 4A:
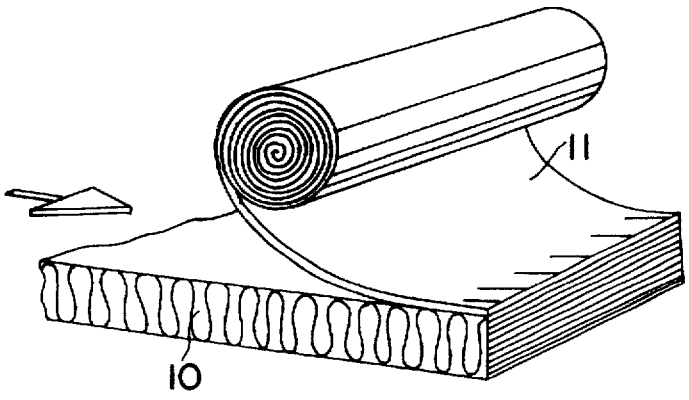

FIG. 4*a* illustrates the first step of the present method. In this step a metal foil or plastics film 11 is applied onto a mineral fibre web 10, the film 11 being connected to the top side of the mineral fibre web by means of a polyethylene adhesive (not shown) which has been applied onto the underside of the film 11, and which is caused to melt by use of a heat roller (not shown).

Figure 4B:
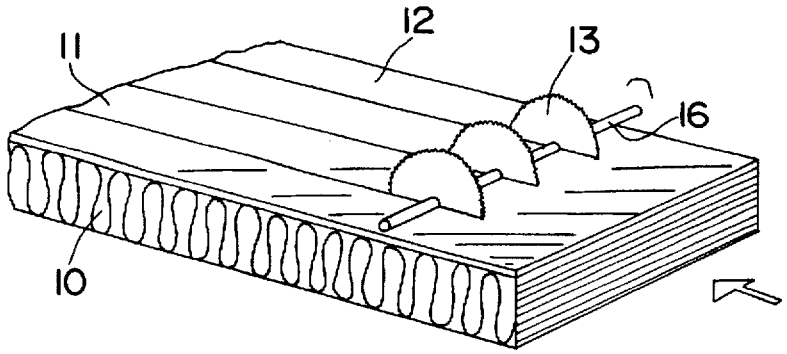

As shown in FIG. 4*b*, the laminated mineral fibre web 10 formed in the first step is cut into lamellae 12 by means of saw blades 13 which are mounted on a common shaft 14 driven by a motor (not shown).

Figure 4C:
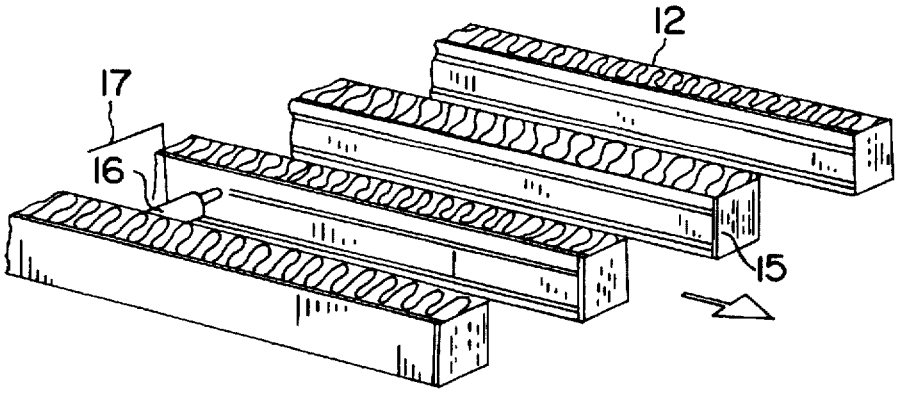

In a subsequent step (not illustrated) the lamellae 12 formed by the cutting operation are turned 90° about their longitudinal axes so as to take the position shown in FIG. 4*c* where the film strips 15 formed by the cutting of the film 11 are now arranged in vertical planes and face the portion of an adjacent lamella which was previously part of the underside of the web 10.

By means of nozzles 16 with a supply inlet 17, binder is then applied, e.g., hot melt, in the form of two parallel strings on one or both of the surfaces.

Figure 4D:
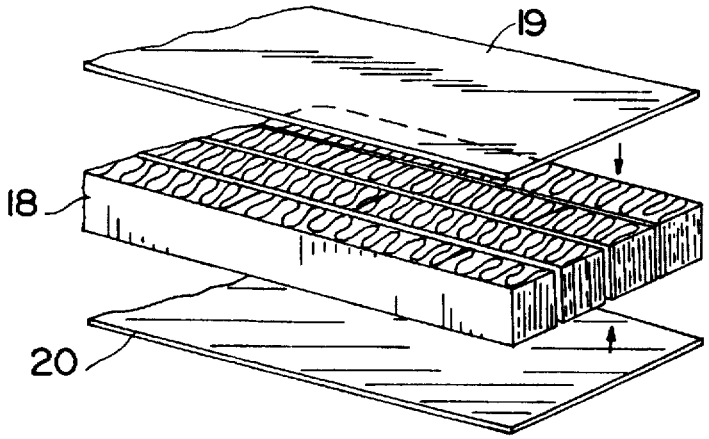

In a subsequent step (not illustrated) the adjacent lamellae are combined following mutual displacement in the longitudinal direction whereby they are bonded by means of the binder applied onto the adjacent surfaces to a web 18 in an offset manner (see FIG. 4*d*).

As will appear from FIG. 4*d*, a vapor-proof coating is applied onto both the top side and the underside of the web 18, e.g., in the form of metal foils 19,20, the metal foil 19 being provided with a layer of a binder (not-shown), which penetrates the web 18 into such a depth that a vapor-proof connection is obtained between the upwardly facing side edges of the film strips 15 and the metal foil 19, prior to its contact with the top side of the web 18. In a corresponding manner, the metal foil 20 is connected to the underside of the web 18. This produces a plate element which, following cutting into suitable lengths, will have an appearance similar to the element shown in FIGS. 1–3.

We claim:

1. Insulating plate element comprising a heat-insulating core layer (1,10) open to diffusion, with a vapor-proof outer layer (4,5; 19,20) coated on opposite sides of said core layer, and a plurality of vapor-proof separating layers (3,15) which extend through said core layer perpendicularly to the vapor-proof outer layers (4,5;19,20) and which are connected to said outer layers in a vapor-proof manner.

2. Insulating element according to claim 1, wherein the core layer consists of mineral fibre lamellae (2,12).

3. Insulating element according to claim 2, wherein the fibres in the mineral fibre lamellae (2,12) are oriented in planes substantially perpendicular to the outer layers (4,5;19,20).

4. Insulating element according to claim 1, wherein the core material (1,10) consists of rock wool having a density of from 50 to 170 kg/m$^3$.

5. Insulating element according to claim 1, wherein the vapor-proof separating layers (3,15) consist of metal foil or plastics film strips.

6. Insulating element according to claim 1, wherein the outer layers consist of metal layers.

7. Insulating element according to claim 1, wherein the vapor-proof separating layers (3,15) are connected to the outer layers by means of a foamed binder.

8. Method of producing an insulating plate element comprising the steps of applying a vapor-proof layer (11) onto at least one side of a plate or a web (10) of an insulating core material which is open to diffusion, cutting the plate or web thus produced into lamellae (12), turning the lamellae (12) 90° about longitudinal axes thereof and adhering said lamellae to each other to form a plate, strips (15) of the vapor-proof layer forming a separating layer between adjacent lamellae (12), coating both sides of the plate or web thus produced with a vapor-proof outer layer in such a manner that vapor-proof connections are obtained between the edges of the separating layers and the outer layers (19,20), and cutting the web into desired lengths.

9. Method according to claim 8, the application of the outer layers is carried out by using a foamed binder.

10. Method according to claim 9, a foamed polyurethane binder is used.

11. Method according to claim 8, wherein the plate or the web of interconnected lamellae (12) with intermediate separating layers (15) is smoothened on opposite sides prior to the application of the outer layers (19,20).

12. Method according to claim 8, wherein the plate or the web (10) of insulating core material which is open to diffusion is coated with a vapor-proof layer of such dimensions that it can cover the side edges of the plate or the web (10).

13. Method according to claim 12, wherein the portions of the vapor-proof layer which are to cover the side edges of the plate or the web are folded over the plate or the web (10) when it is cut into lamellae (12) and are subsequently adhered to the ends of the lamellae produced.

* * * * *